US007584863B2

(12) United States Patent
Bucher et al.

(10) Patent No.: US 7,584,863 B2
(45) Date of Patent: Sep. 8, 2009

(54) CONTAINER

(75) Inventors: Hubert Bucher, Deggenhauser Tal (DE); Roland Krause, Friedrichshafen (DE); Andreas Serden, Meersburg (DE); Albert Fritzsche, Markdorf (DE)

(73) Assignee: EADS Deutschland GmbH, Ottobrunn (DE)

( * ) Notice: Subject to any disclaimer, the term of this patent is extended or adjusted under 35 U.S.C. 154(b) by 743 days.

(21) Appl. No.: 10/501,382

(22) PCT Filed: Jan. 13, 2003

(86) PCT No.: PCT/DE03/00079

§ 371 (c)(1),
(2), (4) Date: Aug. 4, 2005

(87) PCT Pub. No.: WO03/059687

PCT Pub. Date: Jul. 24, 2003

(65) Prior Publication Data

US 2006/0006174 A1 Jan. 12, 2006

(30) Foreign Application Priority Data

Jan. 16, 2002 (DE) ..... 102 01 362

(51) Int. Cl.
*B65D 88/00* (2006.01)

(52) U.S. Cl. ..... 220/1.5; 220/592.2

(58) Field of Classification Search ..... 220/1.5, 220/62.2, 592.2, 592.26; 312/400
See application file for complete search history.

(56) References Cited

U.S. PATENT DOCUMENTS

| | | | | |
|---|---|---|---|---|
| 3,003,810 | A * | 10/1961 | Kloote et al. | 296/181.3 |
| 3,031,044 | A * | 4/1962 | Stitt et al. | 52/508 |
| 3,175,606 | A * | 3/1965 | Talmey et al. | 165/41 |
| 4,021,982 | A * | 5/1977 | Kotcharian | 52/410 |
| 5,460,013 | A * | 10/1995 | Thomsen | 62/239 |
| 5,875,599 | A * | 3/1999 | McGrath et al. | 52/586.2 |
| 6,615,741 | B2 * | 9/2003 | Fecko et al. | 105/404 |

FOREIGN PATENT DOCUMENTS

DE 296 08 385 U1 9/1997

* cited by examiner

*Primary Examiner*—Harry A. Grosso
(74) *Attorney, Agent, or Firm*—Crowell & Moring LLP

(57) ABSTRACT

A container according to ISO standards as a mobile workspace in civilian and military use comprising a cuboid metal frame of ISO corners and edge profiles connecting these ISO corners as well as thermally insulated side walls, ceiling and floor. The edge profiles are designed in two parts and the two partial profiles of an edge profile run parallel to one another and the intermediate space between the two profiles is filled completely by a thermally insulating material, with the side walls, ceiling and floor having a vacuum insulation layer.

11 Claims, 5 Drawing Sheets

CONTAINER

BACKGROUND OF THE INVENTION

This invention relates to a container according to ISO standards, designed as a mobile work space for civilian and military use (shelter)

ISO containers with a cuboid metal structural frame comprising ISO corners and edge profiles connecting these ISO corners, as well as thermally insulated side walls, ceiling and floor are known from DE 37 19 301 C2, for example.

The construction of the structure for CSC-certified stackable containers (1:1 design, not expandable, e.g., DE 37 19 301 C2, and 1:2 and 1:3 expandable designs, e.g., EP 0 682 156 B1) is obtained essentially from the stresses that occur in shipping and the vertical loads that occur when up to nine units are stacked (CSC: International Convention for Safe Containers). Point loads and area loads are specified for the container bottom. The tare weight of the equipment to be mounted there must be applied to the walls. Wall cutouts for doors (emergency exit) and for the power supply, air conditioning ducts and optionally the water supply increase the structural complexity and the number of heat bridges.

The thermal insulation should not be at the expense of the interior size and/or increasing the empty weight of the container. Heat transfer coefficients of 0.55 to 0.75 W/($m^2$K) can be achieved easily with sandwich walls having shearing rigidity (sheet metal-polyurethane-sheet metal) with thicknesses of 40 mm to 60 mm. With current designs, the openings, edges and corners increase the k value of the entire container to values substantially greater than 1 W/($m^2$K).

For civilian and military applications (mobile sanitation facilities and work rooms such as field command posts and communications systems) for use throughout the world, even under extreme climate conditions, there is a need for reducing the technical complexity and economic cost required for the power supply and [heating and] air conditioning. Transmission losses of the container, which is closed on all sides, may constitute 30% or more of the heating and cooling demand, except for applications with an extremely high fresh air demand (operating rooms).

The problem of substantially improving the thermal insulation cannot be solved by thicker thermal insulation layers and not with the usual structural designs.

DE 197 47 181 A1 discloses a refrigerated container or insulated container which includes thermally insulated side walls plus ceiling and floor, each framed by bordering copings. The bordering copings are designed as hollow profiles and have a core of thermal insulation material. By way of edge profiles designed in two parts, the side walls, ceiling and floor are fixedly joined together in the area of the bordering copings. One disadvantage of this container is the fact that heat bridges created due to the use of the hollow profiles have a negative effect on the heat transfer coefficient value of the container.

EP 0 064712 A1 describes a refrigerated container having a continuous insulation layer. The exterior side of the insulation is formed by a steel frame with upper and lower cross beams and exterior wall panels. Interior planking is provided on the inside of the refrigerated container.

SUMMARY OF THE INVENTION

An object of the present invention is to reduce the heat transfer coefficient of the entire container without any sacrifice in terms of structural rigidity and interior size.

This object has been achieved by providing that the intermediate space between the two partial profiles is filled completely by a thermally insulating material and side walls, ceiling and floor have a vacuum insulation layer.

The present invention links two approaches together to achieve this object:

Reducing the transmission component of undisturbed areas by using vacuum insulation material which has a much lower thermal conductivity than polyurethane or mineral wool, for example, to compensate for the disadvantage of heat bridges, and A two-part design of all edge profiles of the container (in the form of two partial profiles running in parallel and thermally separated from one another by thermal insulation material) for all horizontal and perpendicular edges of the cuboid ISO container. The intermediate space between the two partial profiles is filled completely by a thermal insulation material. This principle can also be applied similarly for all frames of area openings such as doors and drop doors. The structure of the container can thus be implemented largely without heat bridges.

The heat transfer coefficient of the container according to this invention can be brought into the range of 0.5 W/($m^2$K) by the measures described here without having to accept sacrifices in terms of structural rigidity or interior size. In particular, the inventive container can be stacked several units high without restriction.

The definite reduction in the heat transfer coefficient to values around 0.5 W/($m^2$K) in the case of a wall thickness comparable to that of conventional thermally insulated containers reduces the required capacity of the air conditioning system by the amount that results from the temperature difference between the interior and the environment and the greater temperature difference (plus and minus) between the air-conditioned air circulating in the side wall ducts and ceiling ducts. Heating of the container by radiant wall heat and/or floor heating thus becomes much more economical.

The inventive concept may be used for containers that are not expandable (1:1 design) as well as for expandable containers (1:2 design, 1:3 design, e.g., using pull-out elements).

The inventive container is in compliance with the strength and rigidity values stipulated by ISO standards. It is suitable in particular for stacking (up to nine containers stacked one above the other) and it withstands the stresses that occur (e.g., load due to crane vehicle) in shipping of the container, in which case the force is applied at the ISO corners.

The vacuum insulation technology developed for terrestrial applications is known per se and is used in the present invention (e.g., DE 296 08 385 U1); this translates into a reduction in the weight and volume of the insulation material and thus an increase in the useful volume at a predetermined heat transfer coefficient. A granular or fibrous filler material together with a getter material, if necessary, and IR opacifiers is surrounded by a multilayer laminated film (metal foil and polyethylene film). With a system pressure of less than 5 mbar, tight welding of the films and a negligible permeation rate, a lifetime of more than 15 years is achieved at a thermal conductivity of approximately 0.004 W/(mK) according to the manufacturer's information. The size of the vacuum insulation sheets in the thickness range from 10 mm to 30 mm can be adapted to the geometric requirements.

The vacuum insulation, which is sensitive to damage, is advantageously protected toward the outside by the outer steel plate wall of the container and is preferably protected toward the inside by plastic-laminated plywood boards, the thickness of which is dimensioned for appropriate mounting of furnishings and/or to accommodate floor loads according to the use case of the container.

In an advantageous embodiment, in addition to an insulation layer of a vacuum insulation material, an additional insulation layer of traditional insulation materials (mineral wool, rock wool, Styropor, Styrodur, polyurethane, etc.), i.e., non-vacuum insulation materials, may also be provided toward the interior.

The edge profiles which run vertically and horizontally between two ISO corners can absorb normal forces and bending forces and may advantageously be designed as two partial L-shaped profiles merged together but also as two quarter circle profiles on the inside and outside or as an expander quarter round profile and a partial profile on the inside comprising a quadrilateral profile or a tube profile.

The outer sheet metal wall of a container surface, which contributes toward its shear strength, is advantageously welded to the outer partial profile of an edge profile and the ISO corners.

The large-area interspaces between opposing edge profiles are covered with vacuum insulation sheets, small intermediate spaces are filled with foam or with other conventional insulation materials tailored exactly to fit.

The intermediate spaces between two partial profiles of an edge profile may also be filled with foam or with conventional insulation materials accurately tailored to fit. The recent development of a weldable steel plate-polyurethane sandwich may be of interest here both economically and from the standpoint of manufacturing technology.

With the small thickness of the walls and ceilings and the minor offset of the wall surfaces at the ISO corners, they protrude into the interior of the container. To reduce these heat bridges, these protrusions must be covered with a layer of thermal insulation material in the form of a trunk corner. Especially here but also on all thermally critical locations, the thermal insulation is such that the dew point can never be reached anywhere on the inside surface.

One wall (side wall, ceiling or floor) of the container advantageously comprises the following layers from the inside to the outside:

outer metallic cover layer, vacuum insulation layer, additional insulation layer of a non-vacuum insulation material, plywood layer, inner metallic or plastic cover layer.

To reinforce the side wall, ceiling or floor, reinforcing profiles may advantageously also be provided, these profiles being in contact either with the inner or outer metallic cover layer of a side wall, a ceiling or floor and separated from the other cover layer by a thermal insulation intermediate layer. Since the reinforcing profiles form essentially unwanted heat bridges, a metallic material with a low thermal conduction and a high strength may advantageously be selected for them.

To accommodate floor loads in spots and over the area, a compromise must be made for thermal reasons between thermal conduction, the cross profile of the profile and the distance between the reinforcing profiles (grid dimension). In addition to the choice of the smallest possible web thickness of the standard profiles, it may also be expedient to use composite welded profiles, with stainless steel plate being advantageous thermally for the web(s), either straight or inclined, because of the lower heat transfer coefficient.

BRIEF DESCRIPTION OF THE DRAWINGS

These and other objects, features and advantages of the present invention will become more readily apparent from the following detailed description of currently preferred configurations thereof when taken in conjunction with the accompanying drawings wherein.

DETAILED DESCRIPTION OF THE DRAWINGS

Figure 1:
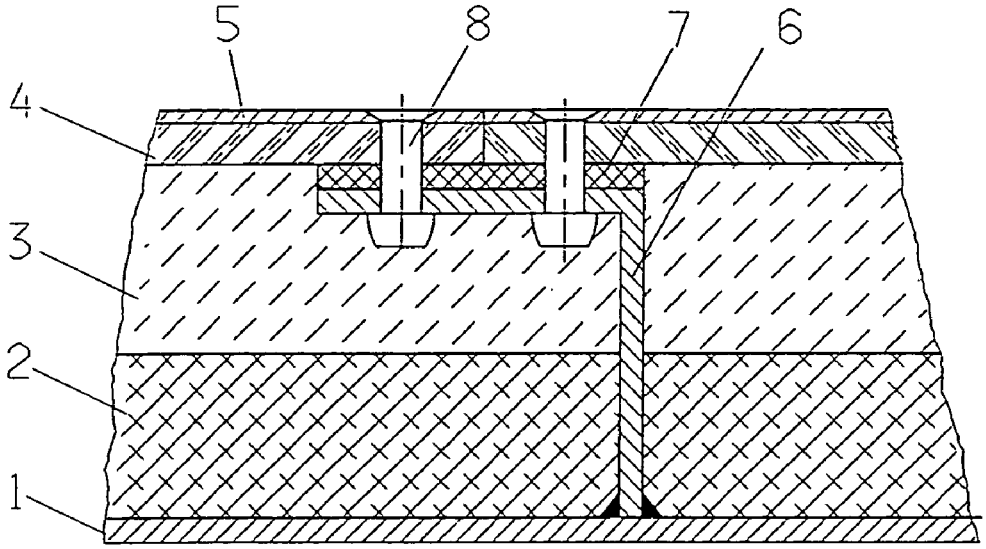
FIG. 1 is a partial, cross-sectional view showing the wall design of the container of the present invention with an L-shaped reinforcing profile.

FIG. 1 shows the wall structure (side walls, floor or ceiling) of container constructed in accordance with the present invention. Beginning from the outside, the multilayer wall structure includes the metallic outside wall 1 (steel plate which is planar or trapezoidal), a layer of vacuum insulation sheets 2 cut to size and inserted and having a thickness which depends on the requirement[s] regarding the quality of the heat transfer, the intermediate layer 3 of conventional insulation materials, e.g., mineral wool, a plywood 4 with a high E modulus to reinforce the wall for secure fastening of the interior furnishings of the container and finally the aluminum cover layer 5 which is to be glued onto the wooden board before assembly.

The total wall thickness is obtained from the wall stiffness requirements which are to be met with the lowest possible web thickness of the reinforcing profile 6 and the greatest possible web length (for definition of a web of a reinforcing profile). Between the L-shaped reinforcing profile 6 and the plywood board 4 a strip 7 of thermal insulation material is inserted. In the present case the reinforcing profile 6 is welded to the metal exterior wall 1 and the wooden boards 4 are attached by a rivet joint 8.

Figure 2:
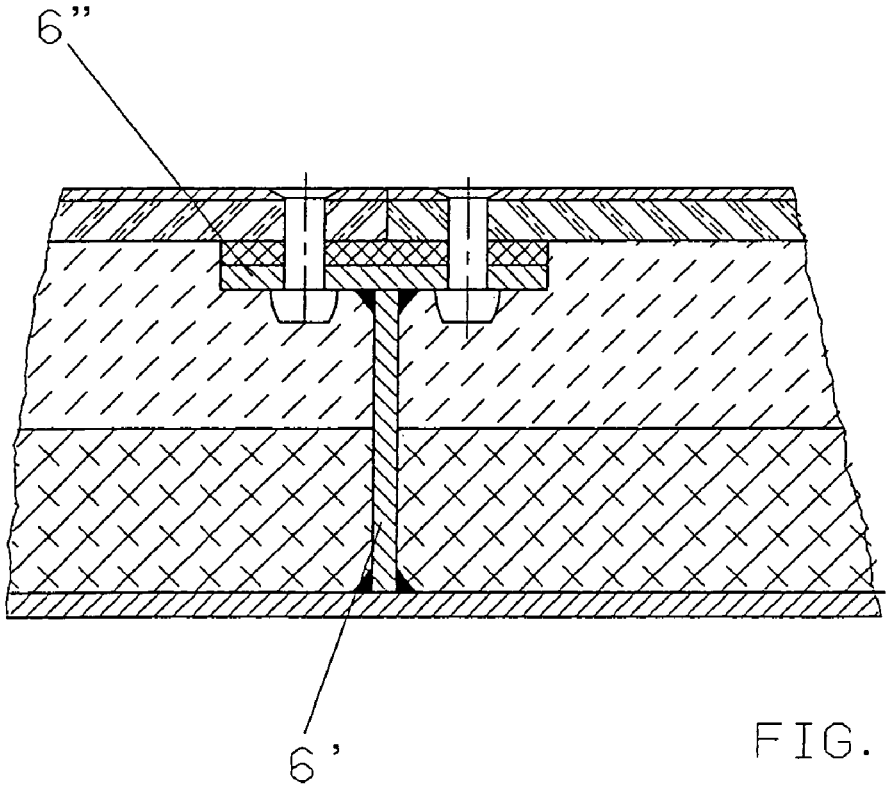
FIG. 2 is a partial, cross-sectional view showing the wall design of the container of the present invention with an assembled reinforcing profile.

A variant of the reinforcing profile 6 is shown in FIG. 2 and consists of selecting stainless steel as the material for the web 6' (i.e., the region of the profile 6 which runs across the layer structure and thus in the direction of heat conduction) for reasons of lower heat conduction and to weld it to the belt 6" while otherwise having the same structure. In FIG. 2 the reinforcing profile is designed in a T shape.

The path of the heat conduction may also be extended by placing the web 6' at an inclination. A symmetrical arrangement of two webs 6' per profile is expedient (symmetrical to a plane of symmetry perpendicular to the wall of the container), so that the webs 6', belt 6" and exterior wall 1 form a trapezoid. The resulting hollow space can be filled out with foam.

Figure 3:
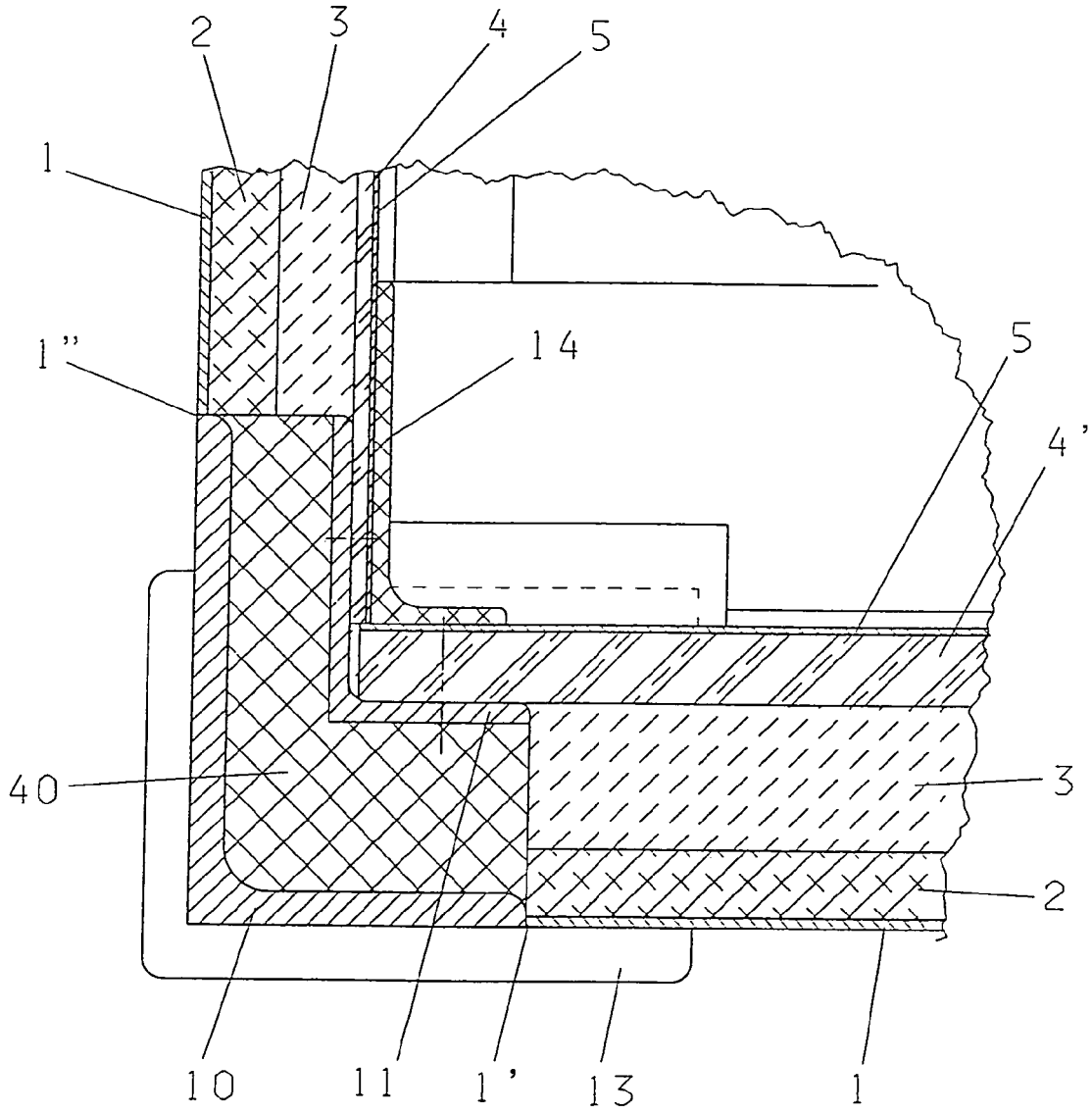
FIG. 3 is a partial, cross-sectional view through a container of the present invention in the area of an edge profile, where the edge profile consists of two L-shaped partial profiles.

FIG. 3 shows a vertical cross section through a container, with part of a side wall and the bottom or floor being shown here. The side wall and bottom have the sequence of layers according to FIG. 1 or FIG. 2: namely exterior cover metal plate 1, vacuum insulation layer 2, insulation layer of traditional insulation material 3, plywood board 4, 4', interior metal cover layer 5. It can be seen here that within the bottom, the plywood layer 4' is slightly thicker than in the case of the corresponding plywood layer 4 in the side wall and the roof (the roof not being shown in FIG. 3). The edge profile of the container is formed from two L-shaped partial profiles 10 and 11 placed one inside the other, welded together at their end faces with ISO corners (one ISO corner 13 is visible in this sectional drawing). The outer cover plates 1 are welded at points 1' and 1" to the profile legs of the outer partial profile 10. The intermediate space between the interior and exterior profiles 10, 11 is filled with insulation material 40, inserted after the welding operation or foamed in place. The entire intermediate space between the profiles 10, 11 is thus filled homogeneously by the insulation material 40 so there are no heat bridges. In particular there are no other beam profiles (in contrast with the abovementioned DE 197 47 181 A1, for example) between the two partial profiles 10, 11. Preferably a non-vacuum insulation material is used as the insulation material. The cover angle 14 preferably made of plastic covers the seam between the floor and the side wall.

Figure 4:
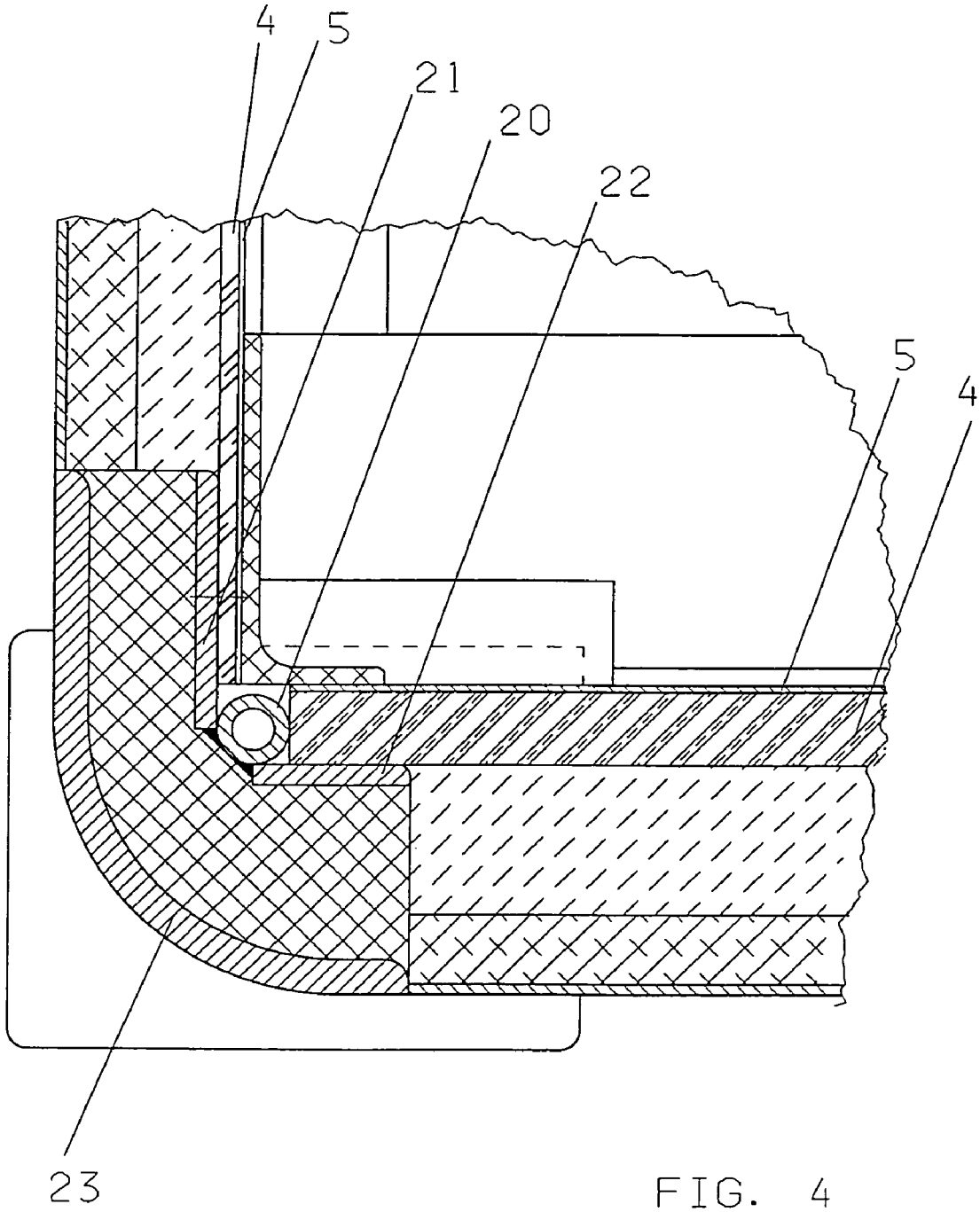
FIG. 4 is a partial, cross-sectional view through a container of the present invention where the edge profile includes a curved partial profile on the outside and a partial profile of a pipe profile with webs welded onto it on the inside.

If a greater rigidity is necessary for the horizontal container edges around the bottom, then according to FIG. 4 the interior partial profile may have a greater cross section, e.g., may be designed as a hollow profile member such as a tube or pipe 20 with tabs 21, 22 welded on for fastening the interior covers 4 and 5 and/or 4' and 5'. The exterior partial profile of the two-part edge profile is designed as an arc of a circle 23 in this embodiment.

Figure 5:
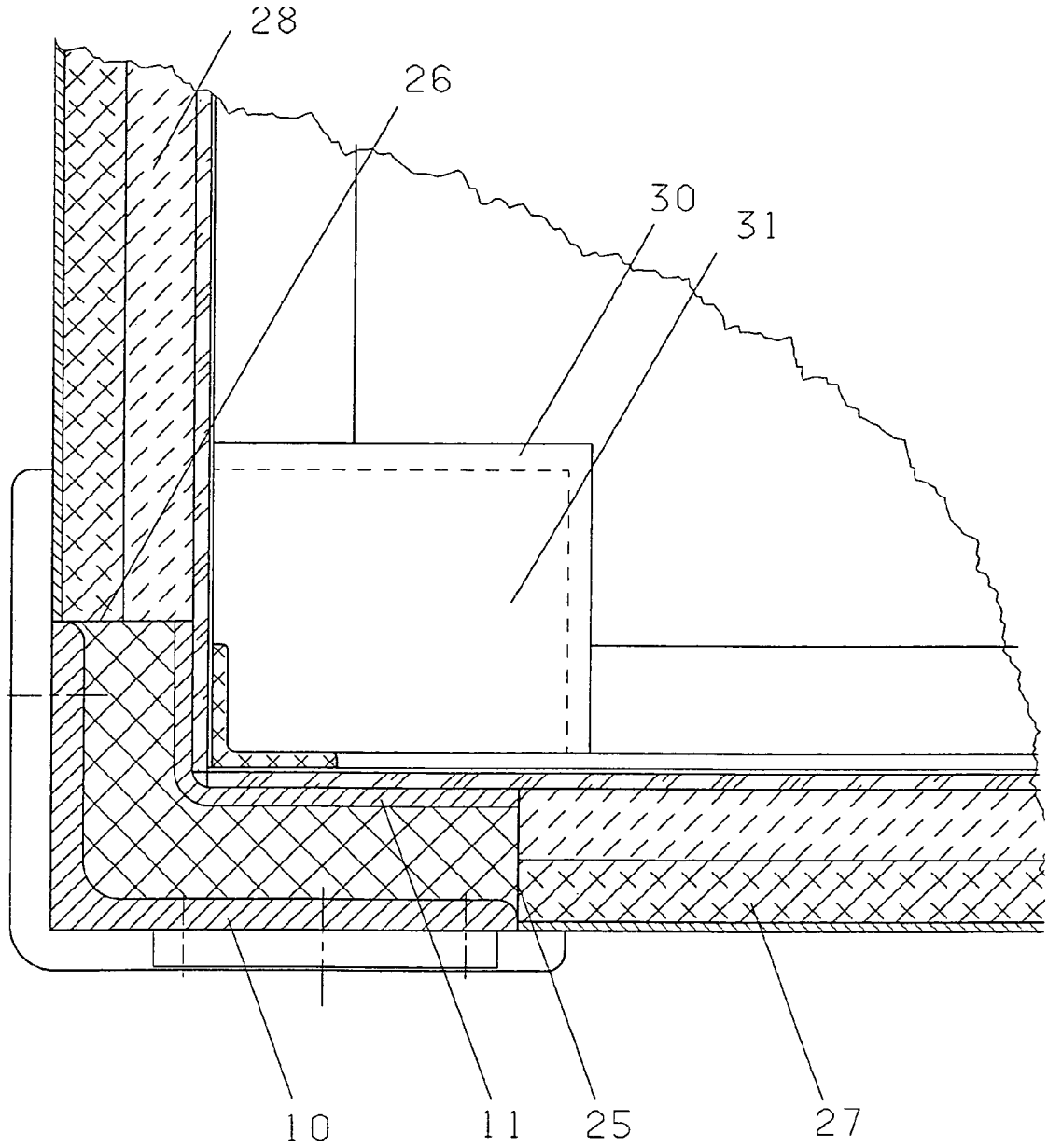
FIG. 5 is a partial, cross-sectional view through a container of the present invention with an edge profile consisting of two L-shaped partial profiles.

FIG. 5 shows a horizontal cross section through a container in the area of a vertical container wall. The two abutting side walls designed according to FIG. 1 and FIG. 2 can be seen here. The two-part edge profile again consists of the two L-shaped partial profiles 10, 11 whose end faces are welded to a surface of the ISO corner 31. If the leg lengths of conventional L profiles cannot be coordinated with their distance so that there is no offset in the joints 25, 26 in relation to the walls 27, 28, this does not constitute in principle a structural change in the wall design. The three-layer lining 30, e.g., a foamed surface compacted plastic, covers the areas of the ISO corners 31 protruding into the interior of the container to diminish the effect of the heat bridge formed by the ISO corner.

Figure 6:
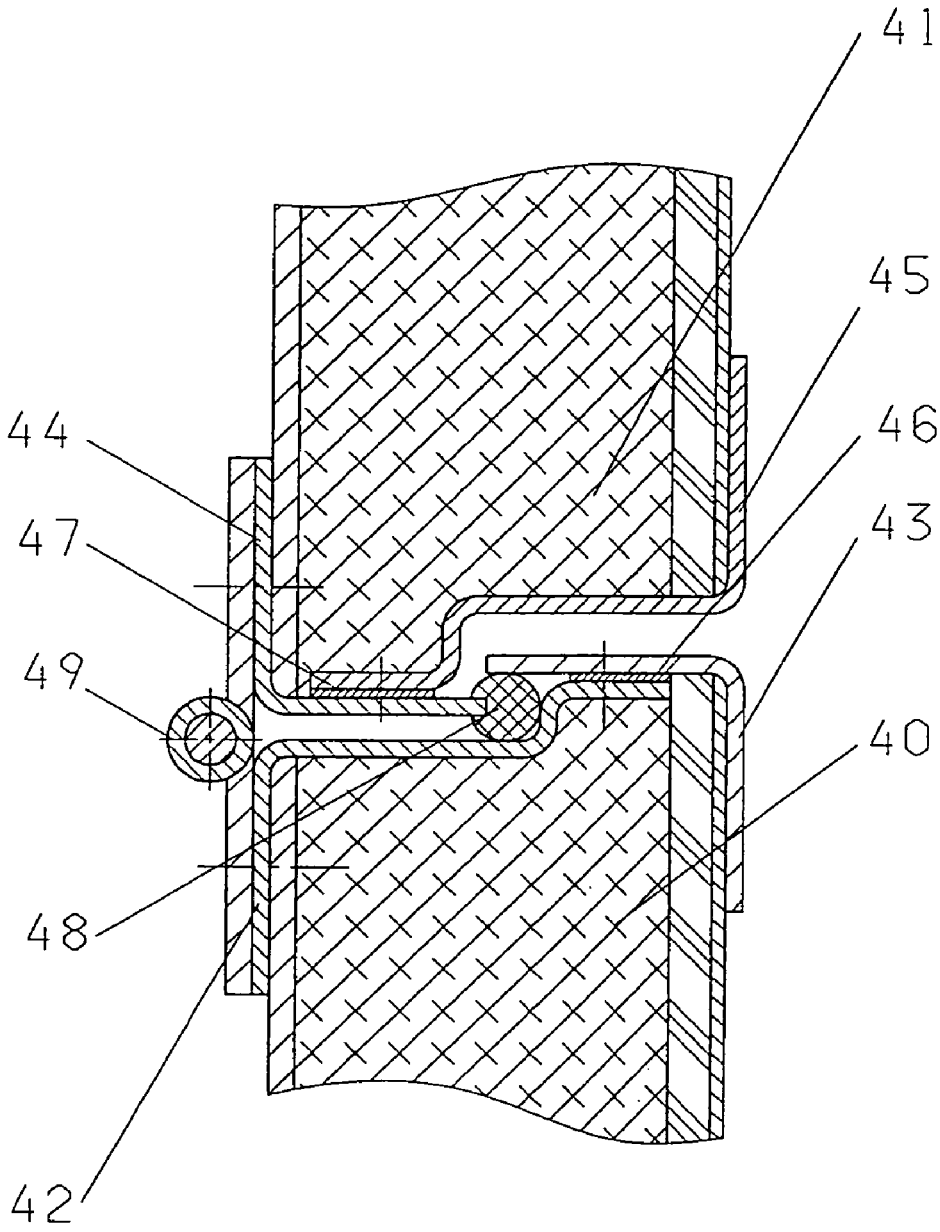
FIG. 6 is a partial, cross-sectional view through a container of the present invention in the area of a wall passage for a door or a drop door.

FIG. 6 shows one interrupted embodiment of a wall opening for a door or drop door. The layer structure of the wall 40 and of the door or drop door 41 is identical. The layer structure depicted here has only an insulation layer consisting of a vacuum insulation material in contrast with the embodiments depicted in the previous figures. The opening is bordered on the side of the drop door as well as on the wall side by ceiling panels 42, 43 and/or 44, 45 in two parts. The intermediate thermal insulation layers 46, 47 between the ceiling panels 42, 43 and/or 44, 45 prevent the transfer of heat. The element 48 provides the seal around the frame. The hinges 49 are mounted on the outside of the container.

The invention claimed is:

1. Container according to ISO standards as a mobile workroom, comprising a cuboid metal frame of ISO corners and edge profiles connecting the ISO corners, thermally insulated side walls, ceiling and floor, wherein the edge profiles are comprised of outer and inner parallel partial profiles and a thermal insulating material arranged in an intermediate space between the outer and inner partial profiles, the side walls, ceiling and floor have an associated vacuum insulation layer, and each of the outer partial profiles is butt-welded to a cover plate associated with an adjoining side wall to form a planar surface.

2. Container according to claim 1, wherein the two-part edge profiles are L-shaped partial profiles placed one inside the other as two partial quarter-round profiles on the inside and on the outside or as an exterior partial quarter-round profile on the outside and on the inside a hollow profile member having tabs welded on two sides.

3. Container as claimed in claim 2, wherein the hollow profile member has a tubular shape.

4. Container as claimed in claim 1, wherein a side wall, ceiling or floor each comprises from the outside thereof to the inside thereof an exterior metal cover layer, a vacuum insulation layer, an insulation layer of a non-vacuum insulation material, a plywood layer, and an interior metal or plastic cover layer.

5. A container as claimed in claim 4, the two-part edge profiles are L-shaped partial profiles placed one inside the other as two partial quarter-round profiles on the inside and on the outside or as an exterior partial quarter-round profile on the outside and on the inside a hollow profile member having tabs welded on two sides.

6. Container as claimed in claim 5, wherein the hollow profile member has a tubular shape.

7. Container as claimed in claim 4, wherein reinforcing profiles are provided for reinforcing the side wall, ceiling or floor, and are in contact either with the interior metal cover layer or the exterior metal cover layer of the side wall, ceiling or floor and are separated from the other cover layer by an intermediate layer of thermal insulation.

8. Container as claimed in claim 7, where a web of a reinforcing profile of the container surfaces consists of a metal material, having a low thermal conductivity.

9. Container as claimed in claim 8, wherein the metal material is stainless steel.

10. Container as claimed in claim 1, wherein the areas of the ISO corners which protrude into the container interior are covered with a thermally insulating material.

11. Container as claimed in claim 1, wherein the container has openings for doors or drop doors on the side wall, bottom or ceiling, with the frame for the openings and/or drop doors being thin-walled and made of a metal material having a low thermal conduction, and with partial profiles of the frame which are in contact with the inside or outside of the container being separated by a thermally insulating layer.

* * * * *